US011739612B2

(12) United States Patent
Elston et al.

(10) Patent No.: US 11,739,612 B2
(45) Date of Patent: Aug. 29, 2023

(54) BALL VALVE FOR IMPROVED PERFORMANCE IN DEBRIS LADEN ENVIRONMENTS

(71) Applicant: Schlumberger Technology Corporation, Sugar Land, TX (US)

(72) Inventors: Cassius Elston, Pearland, TX (US); Brian Walther, Houston, TX (US); Venkata Siva Reddy Battula, Houston, TX (US); Ashish Sharma, Houston, TX (US); Diana Orzechowski, Damon, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 97 days.

(21) Appl. No.: 17/279,621

(22) PCT Filed: Sep. 16, 2019

(86) PCT No.: PCT/US2019/051246

§ 371 (c)(1),
(2) Date: Mar. 25, 2021

(87) PCT Pub. No.: WO2020/068466

PCT Pub. Date: Apr. 2, 2020

(65) Prior Publication Data

US 2021/0388694 A1 Dec. 16, 2021

Related U.S. Application Data

(60) Provisional application No. 62/736,337, filed on Sep. 25, 2018.

(51) Int. Cl.
*E21B 34/14* (2006.01)

(52) U.S. Cl.
CPC ..... *E21B 34/14* (2013.01); *E21B 2200/04* (2020.05)

(58) Field of Classification Search
CPC ..... E21B 34/14; E21B 2200/04; E21B 34/06
See application file for complete search history.

(56) References Cited

U.S. PATENT DOCUMENTS 7,758,016 B2 * 7/2010 Scott ..... F16K 5/0673 251/192
8,201,632 B2 6/2012 Burnett
(Continued)

FOREIGN PATENT DOCUMENTS

WO 9931350 A1 6/1999
WO 2014130052 A1 8/2014

OTHER PUBLICATIONS

International Preliminary Report on Patentability issued in International Patent Application No. PCT/US2019/051246 dated Apr. 8, 2021, 7 pages.

(Continued)

*Primary Examiner* — Taras P Bemko
(74) *Attorney, Agent, or Firm* — Matthew Goode

(57) ABSTRACT

An isolation valve system includes a well string having an isolation valve including a ball rotatably mounted to a pair of inserts for rotation about a fixed axis, an arm coupled to the ball at a position offset from the fixed axis, and a mandrel connected to an actuation end of the arm, the mandrel and the actuation end of the arm being disposed uphole of the ball. Via the actuation end of the arm, the mandrel forces rotation of the ball from a closed position to an open position by moving in a linear direction away from the ball, which allows flow of fluid along a through hole of the ball.

14 Claims, 6 Drawing Sheets

(56) References Cited

U.S. PATENT DOCUMENTS

| | | | | |
|---|---|---|---|---|
| 8,684,099 | B2 | 4/2014 | Azimi et al. | |
| 2011/0203801 | A1 | 8/2011 | Azimi et al. | |
| 2013/0206417 | A1 | 8/2013 | Kalb et al. | |
| 2016/0003004 | A1* | 1/2016 | Inglis | E21B 34/14 166/373 |
| 2017/0370180 | A1 | 12/2017 | Manett et al. | |
| 2018/0023711 | A1* | 1/2018 | Hawa | F16K 5/0636 137/15.22 |
| 2019/0218883 | A1* | 7/2019 | Inglis | F16K 5/06 |
| 2021/0080011 | A1* | 3/2021 | McMenamy | F16K 37/0033 |

OTHER PUBLICATIONS

International Search Report and Written Opinion issued in the PCT application PCT/US2019/051246, dated Dec. 27, 2019 (10 pages).
First Exam Report issued in India Patent Application No. 202117012587 dated Feb. 15, 2023, 7 pages.

* cited by examiner

BALL VALVE FOR IMPROVED PERFORMANCE IN DEBRIS LADEN ENVIRONMENTS

CROSS-REFERENCE TO RELATED APPLICATION

The present document is based on and claims priority to U.S. Provisional Application Ser. No. 62/736,337, filed Sep. 25, 2018, which is incorporated herein by reference in its entirety.

BACKGROUND

Hydrocarbon fluids such as oil and natural gas are obtained from a subterranean geologic formation, referred to as a reservoir, by drilling a wellbore that penetrates the hydrocarbon-bearing formation. Once the wellbore is drilled, various forms of well completion components may be installed to control and enhance the efficiency of producing the various fluids from the reservoir.

Isolation valves safeguard reservoirs by providing a reliable barrier within the completion tubing string. Isolation valves may utilize a ball valve as the primary barrier mechanism, and the ball valve can be actuated to open and close by a variety of different means (e.g., hydraulically or mechanically).

A challenge all isolation valves must mitigate is operating in dirty, debris laden environments. Dirt, debris, particulates, or any foreign material in the valve have a significant impact on the valve's performance. Specifically, foreign material in the valve increases friction between the internal components of the actuation mechanism of the valve and hinders the valve's ability to open/close and seal. During actuations of the ball valve, the added friction requires the operator to apply more force to the valve's actuation mechanism to overcome the friction. In some cases, the force to overcome the friction can be extreme and can exceed the operator's equipment rating or the isolation valve rating (i.e., the valve cannot open or close because the other equipment used to open/close the valve cannot apply enough force). Consequently, debris is a primary cause of failure for isolation valves and ball valves generally.

Accordingly, there is a need for an actuation mechanism for ball valves with a more robust design for actuating the ball valve in unclean, debris laden environments.

SUMMARY

According to one or more embodiments of the present disclosure, an isolation valve system includes a well string having an isolation valve, the isolation valve including a ball rotatably mounted to a pair of inserts for rotation about a fixed axis, the ball having a through hole, an arm coupled to the ball at a position offset from the fixed axis, the arm having an actuation end, and a mandrel connected to the actuation end of the arm, the mandrel and the actuation end of the arm being disposed uphole of the ball. According to one or more embodiments of the disclosure, via the actuation end of the arm, the mandrel forces rotation of the ball from a closed position to an open position by moving in a linear direction away from the ball, which allows flow of fluid along the through hole.

A method for isolation a formation according to one or more embodiments of the present disclosure includes providing an isolation valve with a ball having a through hole, rotatably mounting the ball within a pair of separately insertable inserts held within a valve housing to enable rotation of the ball about a fixed axis, connecting a first end of an arm to the ball at a position offset from the fixed axis, the first end being an engagement end of the arm, coupling a second end of the arm to a movable mandrel to enable selective shifting of the ball between open and closed positions by movement of the arm, the mandrel and the second end of the arm being disposed uphole of the ball, and using the mandrel, via the second end of the arm, to force rotation of the ball from the closed position to the open position by moving in a linear direction away from the ball, which allows flow of fluid along the through hole of the ball.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various described technologies. The drawings are as follows.

DETAILED DESCRIPTION

Figure 1:
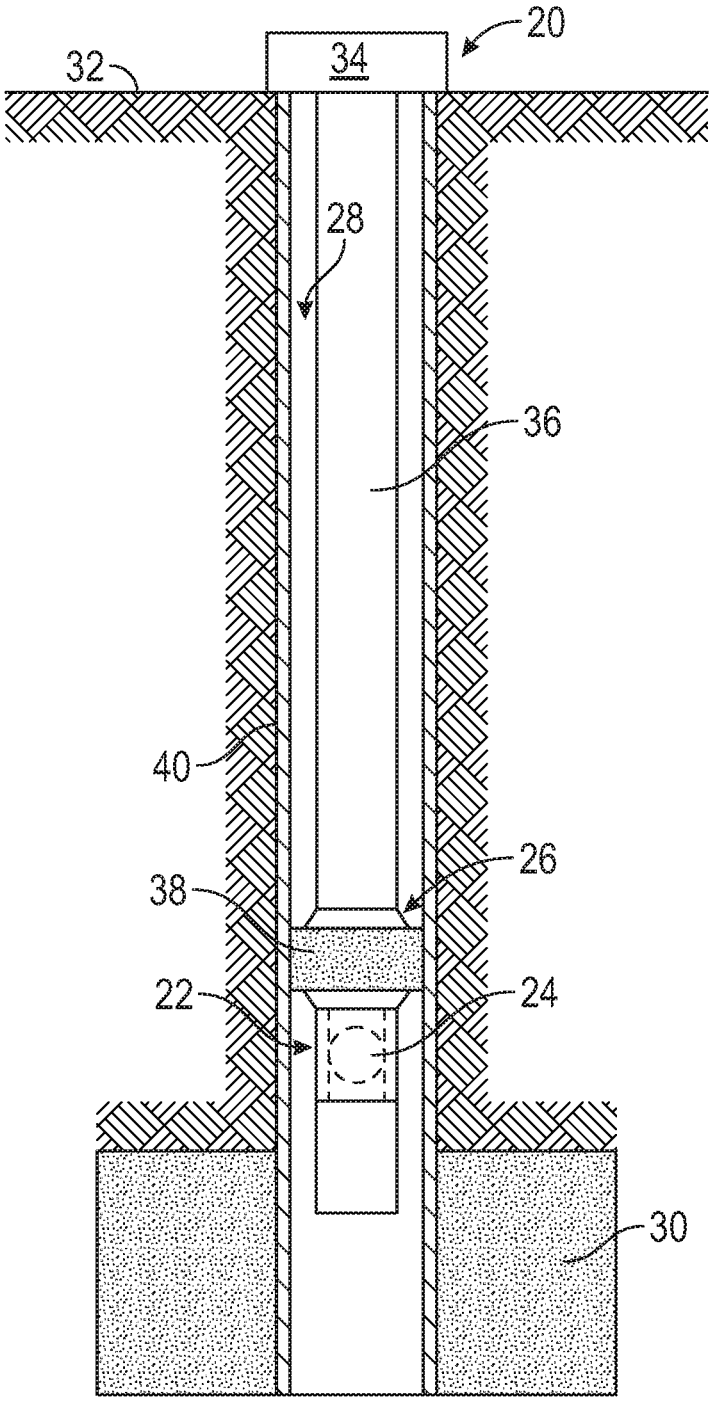
FIG. 1 is a schematic view of a well system having an isolation valve deployed in a wellbore, according to one or more embodiments of the present disclosure.

In the following description, numerous details are set forth to provide an understanding of some embodiments of the present disclosure. However, it will be understood by those of ordinary skill in the art that that embodiments of the present disclosure may be practiced without these details and that numerous variations or modifications from the described embodiments may be possible.

In the specification and appended claims: the terms "connect," "connection," "connected," "in connection with,"

"connecting," "couple," "coupled," "coupled with," and "coupling" are used to mean "in direct connection with" or "in connection with via another element." As used herein, the terms "up" and "down," "upper" and "lower," "upwardly" and "downwardly," "upstream" and "downstream," "uphole" and "downhole," "above" and "below," and other like terms indicating relative positions above or below a given point or element are used in this description to more clearly describe some embodiments of the disclosure.

One or more embodiments of the present disclosure is a ball valve actuation mechanism that generates force to open the ball valve by moving internal components of the actuation mechanism away from the ball valve. As such, one or more embodiments of the present disclosure generally relate to an isolation valve system having a design that is simpler to manufacture and more reliable to use in a well application. This design utilizes simple mechanisms with lower force requirements that enable reliable and repeatable actuation of a ball type flow isolation valve in debris laden environments. Additionally, the design components involved in actuating the valve may be reduced in size/cross-section due to a reduction in stress on the actuation components, which may reduce manufacturing costs.

Current isolation valve actuation mechanisms require the internal components to move towards the ball valve to open the ball valve. In debris laden environments, this direction of motion compacts the particulates accumulated on top of the closed ball valve, thus further increasing the friction on the ball valve. Additionally, the components must plow through the debris prior to engaging the ball valve. Consequently, the force to open the ball valve in current isolation valve systems increases significantly above the normal operating ranges.

According to one or more embodiments of the present disclosure, the actuation mechanism of the isolation valve system is changed so that the ball valve may be opened by moving the internal components away from the ball valve. Notably, the ball valve may be any form or shape that forms a sealing. In one or more embodiments of the present disclosure, the ball valve may be made out of any material such as metallic, thermoplastic, elastomeric, dissolvable, or memory shape alloy, to name a few. As an example, the ball valve could be an elliptical shape or conical shape. Moving the internal components of the actuation mechanism away from the ball creates space for debris to move/flow around the ball valve and relieves the frictional forces on the ball valve, thus decreasing the required force to the valve's actuation mechanism. Moreover, moving the internal components of the actuation mechanism away from the ball creates flow paths for debris to more during ball valve actuation.

In the isolation valve system according to one or more embodiments of the present disclosure, the force required to open the ball valve in debris laden environments is reduced. This force may be generated by various mechanisms including mechanical, hydraulic, gas pressure, electrical, or down hole generated power. Advantageously, this force reduction may have far reaching impacts including improving the reliability of products in downhole conditions and enabling the development of less expensive valves because the force generating mechanism in the valve may be less robust.

Referring generally to FIG. 1, one example of a generic well system 20 is illustrated as employing an isolation valve system 22 comprising at least one isolation valve 24. Well system 20 may comprise a completion 26 or other downhole equipment that is deployed downhole in a wellbore 28. The isolation valve 24 may be one of a wide variety of components included as downhole equipment 26. Generally, the wellbore 28 is drilled down into or through a formation 30 that may contain desirable fluids, such as hydrocarbon-based fluids. The wellbore 28 extends down from a surface location 32 beneath a wellhead 34 or other surface equipment suitable for the given application.

Depending on the specific well application, e.g., such as a well perforation application, the completion/well equipment 26 is delivered downhole via a suitable conveyance 36. However, the conveyance 36 and the components of completion 26 often vary substantially. In many applications, one or more packers 38 is used to isolate the annulus between downhole equipment 26 and the surrounding wellbore wall, which may be in the form of a liner or casing 40. The isolation valve 24 may be selectively actuated to open or isolate formation 30 with respect to flow of fluid through completion 26.

Figure 2:
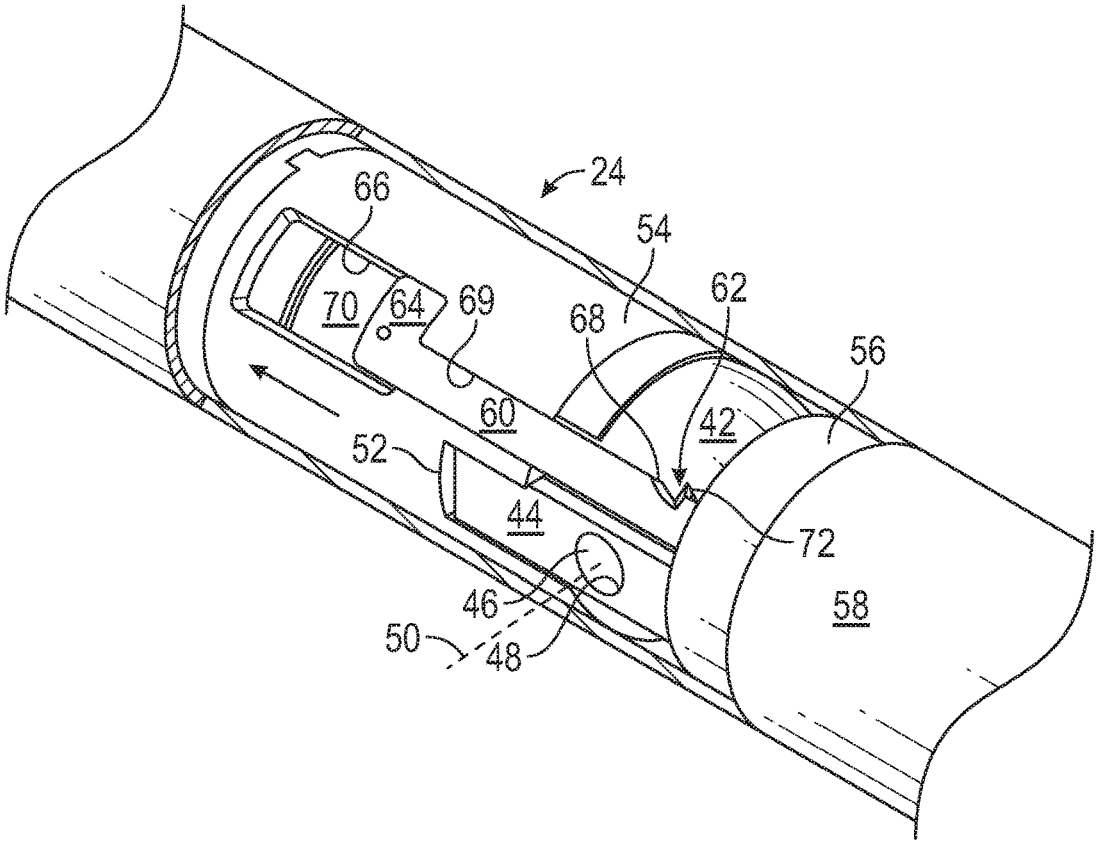
FIG. 2 is an example of an isolation valve system having a ball valve in the closed position, according to one or more embodiments of the present disclosure.
Figure 3:
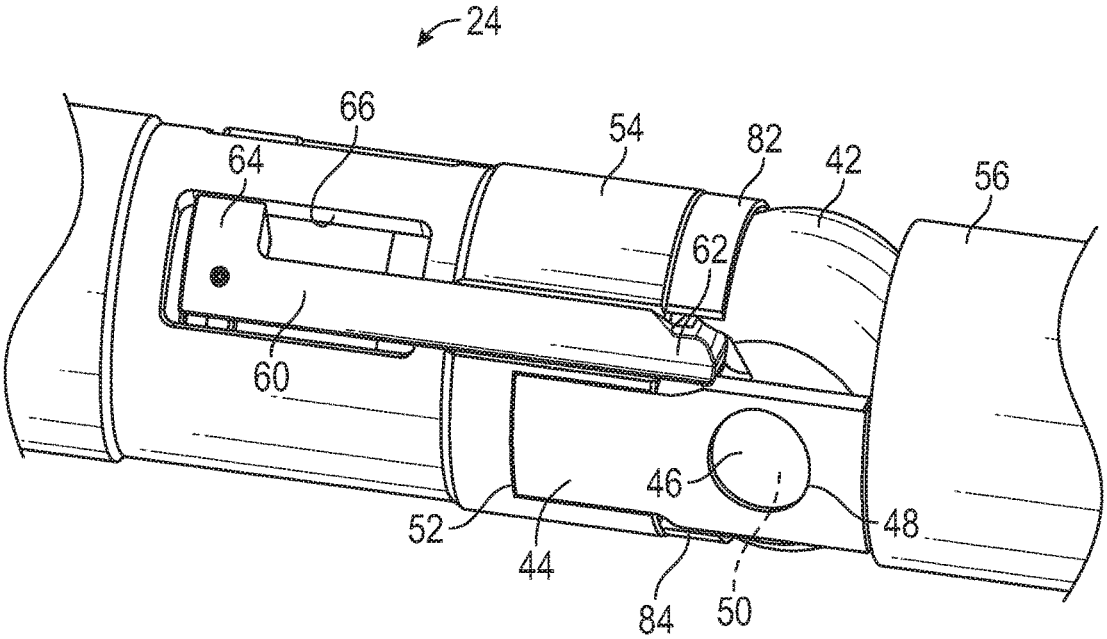
FIG. 3 is an example of an isolation valve system having a ball valve in the open position, according to one or more embodiments of the present disclosure.

Referring now to FIG. 2, an example of an isolation valve system having a ball valve in the closed position, according to one or more embodiments of the present disclosure, is shown. Further, FIG. 3 is an example of the isolation valve system having the ball valve in the open position, according to one or more embodiments of the present disclosure. As shown in FIG. 2 and FIG. 3, the isolation valve 24 comprises a ball 42 that is held in place by inserts 44, with an insert provided on each side of the ball 42 (only one is visible in this view). As illustrated, ball 42 may be a full ball rotatably mounted in inserts 44 via ball trunnions 46 that are rotatably received in corresponding openings 48 formed in the inserts. The ball 42 is thus able to rotate about a fixed axis 50 and no translation of ball 42 is required. According to one or more embodiments, the isolation valve system is designed such that the ball 42 is able to rotate about the fixed axis 50 in a counter-clockwise direction.

Figure 4A:
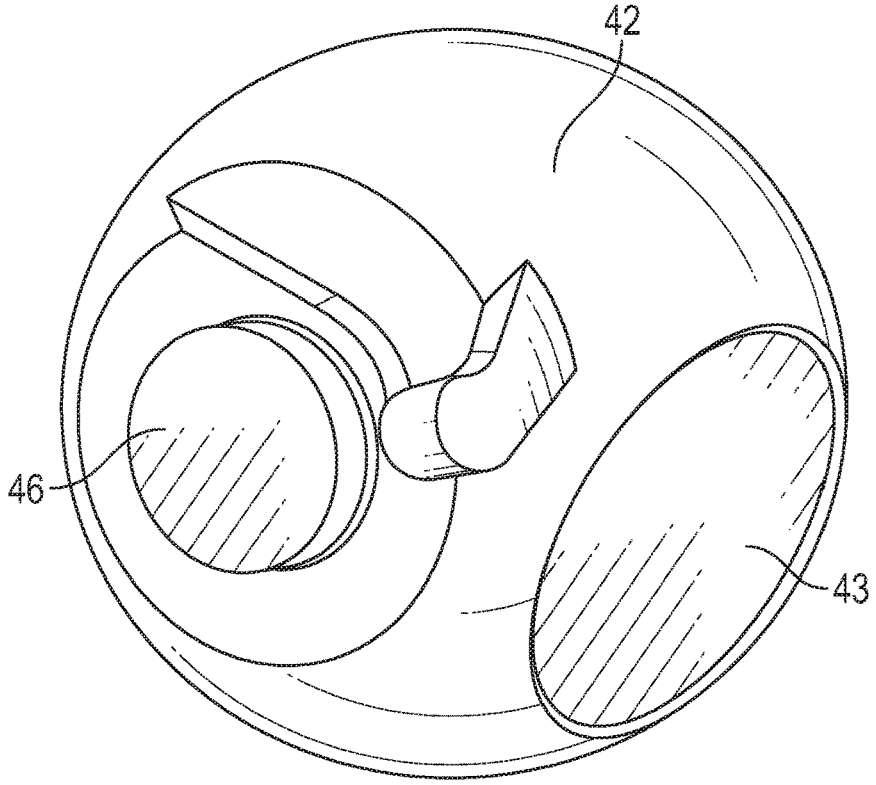
FIGS. 4A and 4B compare a base design and a reverse design of a ball valve, according to one or more embodiments of the present disclosure.
Figure 4B:
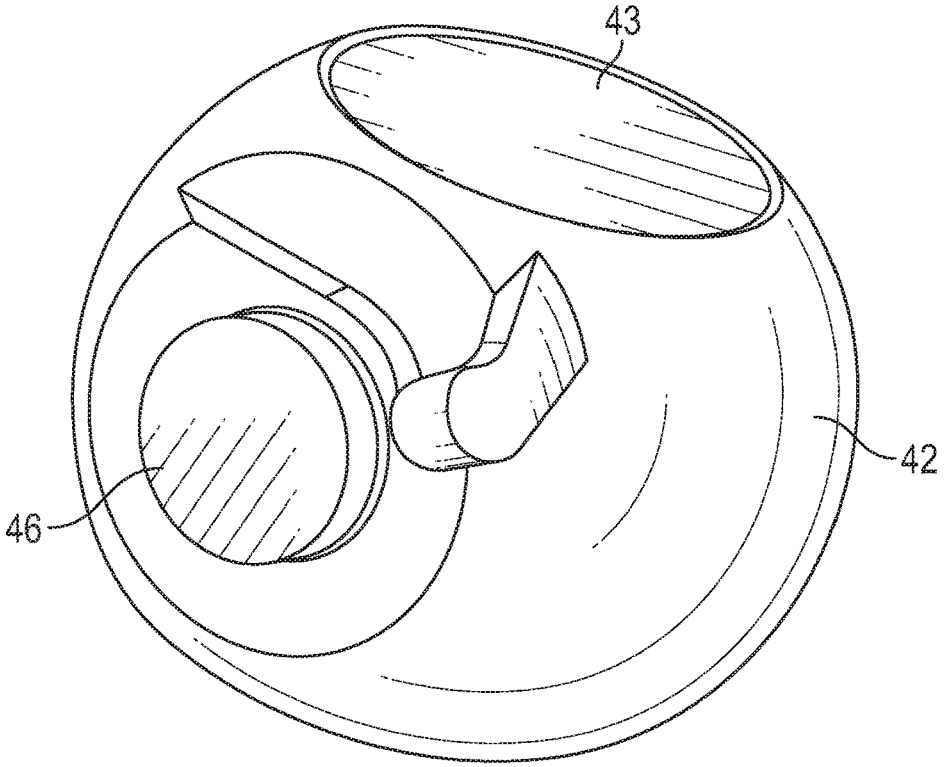

According to one or more embodiments of the present disclosure, the counter-clockwise rotation of the ball 42 about the fixed axis 50 may be accomplished by a reverse design of the ball valve 42. Referring now to FIGS. 4A and 4B, for example, in the reverse design, the through hole 43 of the ball valve 42 may be oriented 90° from the base design.

Referring back to FIGS. 2-3, each insert 44 is positioned in a pocket 52 formed in an upper cage 54 and captured between the upper cage 54 and a lower cage 56. The upper cage 54 and lower cage 56 are contained within a valve housing 58 that may be generally tubular in form. The inserts 44 hold the ball 42 in a manner that enables selective rotation of the ball via at least one arm 60.

A full ball 42 may generally be configured as a spherically shaped valve component intersected by a cylindrically shaped through hole 43. This configuration results in two essentially symmetrical and semi-spherical portions of the ball 42 being respectively exposed to the upstream and downstream environments across the fixed axis 50 when the ball 42 is in a closed position. However, according to one or more embodiments of the present disclosure, the ball 42 may assume any form or shape that is capable of forming a sealing. For example, the ball 42 may be an elliptical shape or a conical shape. Moreover, the ball 42 may be made out of any material in accordance with one or more embodiments including metallic, thermoplastic, elastomeric, dissolvable, or memory shape alloy, for example.

In the embodiments illustrated in FIGS. 2-3, the arm 60 comprises a pair of yoke arms each having an engagement end 62 and an actuation end 64 on generally opposite portions of the arm 60 (only one arm 60 is visible in this view). The arm 60 may be moved linearly in a direction away from the ball 42 (see arrow in FIG. 2) to transition ball 42 between a closed position and an open flow position that enables fluid flow through an interior of isolation valve 24. That is, the yoke arms engage the ball 42 during an upward stroke and rotate the ball 42 from the closed position to the open position. A window 66 may be formed in upper cage 54 to receive actuation end 64 and to limit movement of actuation end 64 so as to control movement of the ball 42 to between the closed and open positions. The engagement end 62 is coupled with ball 42 at a position offset from rotation axis 50 and may move along a slot 68, formed in ball 42, when arm 60 is moved linearly. The slot 68 is formed in a desired pattern to achieve rotational movement of ball 42 between the closed and open flow positions when engagement end 62 is moved along slot 68. In some applications, the arm 60 may be guided during movement by a cage slot 69 formed in upper cage 54.

In the example illustrated, the yoke arm 60 is attached to a movable mandrel 70 at its actuation end 64. The construction enables adjustments to be made with respect to movement of arm 60 and/or the attachment of arm 60 to mandrel 70 for compensation of manufacturing tolerances. The movable mandrel 70 is simply moved in a linear direction through valve housing 58 to cause arm 60 to rotate ball 42 between open and closed positions. Accordingly, in some embodiments, the ball 42 may be actuated by pivoting the ball on its trunnions 46 without significant or, in some cases, any translation of the ball. In one specific example, the pivoting motion is caused by linear motion of arm 60/engagement end 62 which passes through slot 68 in ball 42 and contacts a face 72 to cause rotation of the ball 42. This type of actuation renders ball 42 and the cooperating components less sensitive to debris because the ball itself does not have to translate but rather rotate in place. According to one or more embodiments, the ball 42 only rotates in a counter-clockwise direction to transition from the closed position to the open position. In some embodiments, movement of the ball 42 from the closed position to the open position may include a combination of rotation in a counter-clockwise direction and linear movement. Indeed, because the ball 42 may transition from the closed position to the open position by moving internal components of the actuation mechanism away from the ball 42, movement of the ball 42 may include linear movement without being adversely affected by surrounding debris.

Movable mandrel 70 may be constructed in a variety of configurations for imparting linear movement to arm 60. In some embodiments, mandrel 70 may comprise a tubular member located within valve housing 58 for linear movement along an interior of upper cage 54. However, mandrel 70 may be constructed in a variety of configurations utilizing rods, sleeves, sliding members, pivoting members, and other mechanisms designed to impart the desired motion to arm 60. Additionally, movement of mandrel 70 may be motivated by a variety of actuation systems. For example, the mandrel 70 may be motivated hydraulically via hydraulic fluid supplied via one or more suitable control lines. In other embodiments, the mandrel 70 may be motivated mechanically by shifting the tubing string or running a shifting tool downhole through conveyance 36. However, motor driven systems, electric systems, and other types of systems may also be employed to enable controlled movement of mandrel 70.

Figure 5:
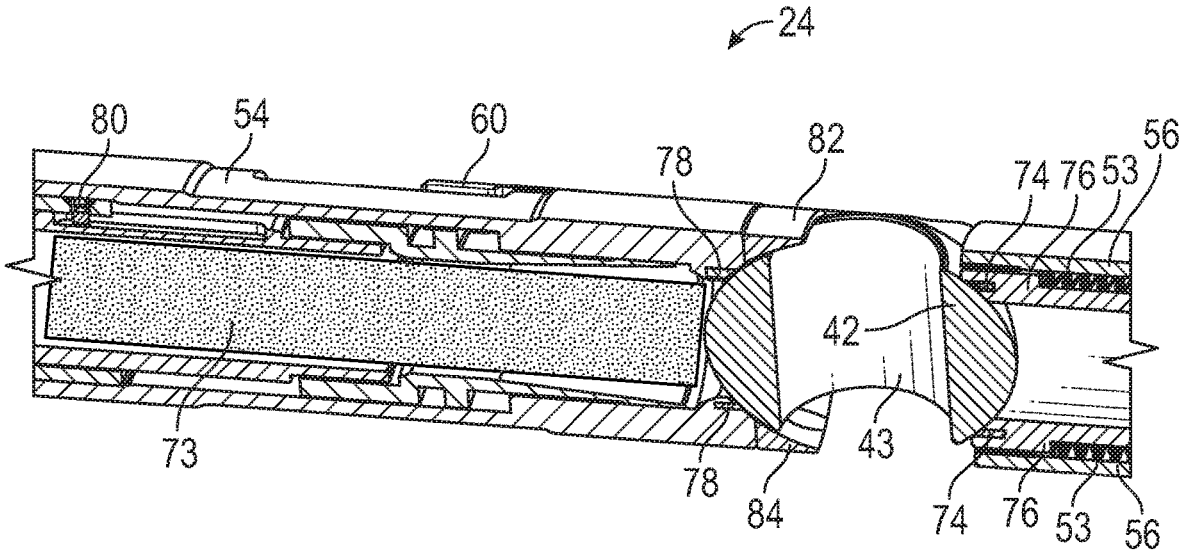
FIG. 5 is an example of a cross-section of an isolation valve system having a ball valve in the closed position, according to one or more embodiments of the present disclosure.
Figure 6:
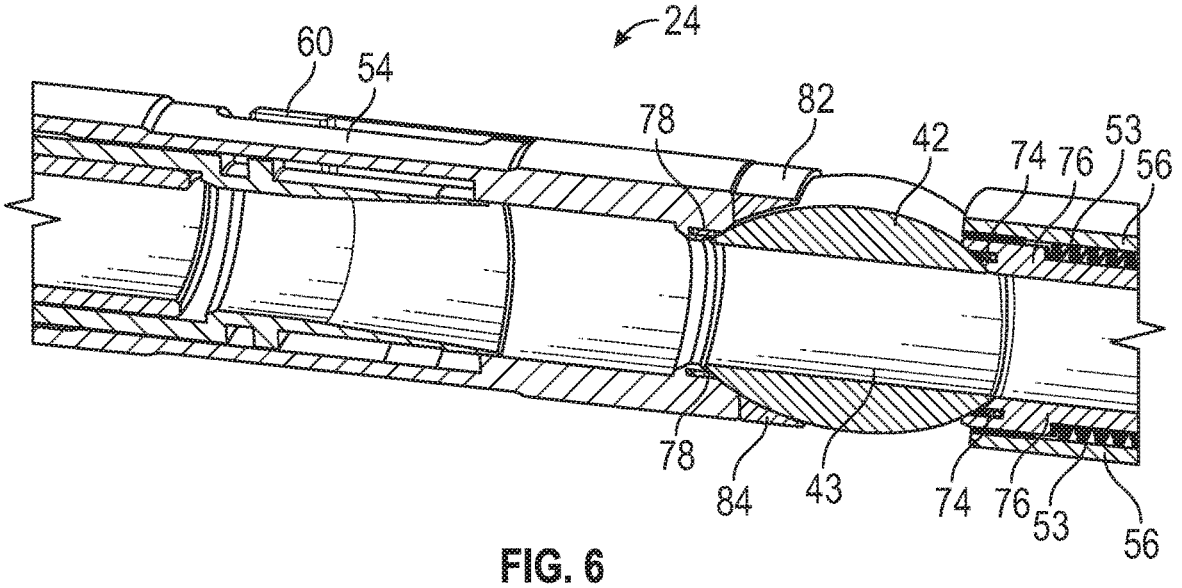
FIG. 6 is an example of a cross-section of an isolation valve system having a ball valve in the open position, according to one or more embodiments of the present disclosure.

Referring now to FIG. 5, an example of a cross-section of an isolation valve system having a ball valve in the closed position, according to one or more embodiments of the present disclosure is shown. Specifically, FIG. 5 shows debris 73 piled on top of the closed ball 42. Further, FIG. 6 is an example of a cross-section of the isolation valve system having the ball valve in the open position, according to one or more embodiments of the present disclosure. As previously described, one or more embodiments of the present disclosure enables the ball valve 42 to open by moving the internal components away from the ball valve 42, thus creating space for debris 73 to move and relieve the frictional forces on the ball valve 42.

As further shown in FIGS. 5 and 6, the ball 42 is illustrated as contacted by a seal 74 disposed along one end of ball 42. The seal 74 is contained in a seal retainer 76, which helps to maintain the seal 74 in contact with the ball 42. According to one or more embodiments, seal retainer 76 may be biased against one end of ball 42 due to resilient member 53 provided within a cavity defined by seal retainer 76 and lower cage 56. In one or more embodiments, resilient member 53 may be one or more wave springs, or another type of spring, for example. Placement of the resilient member 53 between the seal retainer 76 and the lower cage 56 allows for a more uniform continuous internal diameter through the isolation valve 24. Additionally, this configuration may contribute to the debris tolerance of the isolation valve 24 due to the separation of the resilient member 53 from the general flow stream of an open ball 42 within the isolation valve 24.

Still referring to FIGS. 5 and 6, a wiper 78 may be deployed against ball 42 to wipe the ball 42 of debris 73 as it is rotated and to thereby reduce the chance of debris 73 preventing rotation of the ball 42. In the example illustrated, wiper 78 is a ring disposed on a side of ball 42 generally opposite seal retainer 76. The seal 74 and wiper 78 cooperate to facilitate dependable and repeatable motion of ball 42 as the through hole 43 is transitioned between a closed configuration (as illustrated in FIG. 5) in which the ball 42 is rotated to block flow through an interior of the isolation valve 24, and an open flow configuration (as illustrated in FIG. 6).

As shown in FIG. 5, according to one or more embodiments of the disclosure, an alignment pin 80 helps to align the interior of the isolation valve with respect to the upper cage 54. Moreover, the upper filler 82 and the lower filler 84 facilitate the connection between the ball 42 and the upper cage 54, especially during the rotation of the ball 42 from the closed configuration (as illustrated in FIG. 5) and the open configuration (as illustrated in FIG. 6. In one or more embodiments, the fillers may be used to "fill space" around the ball valve 42 so debris 73 cannot accumulate in the voids around the ball valve 42.

One or more embodiments of the isolation valve system of the present disclosure offers several commercial advantages over previous isolation valve systems. For example, the isolation valve system according to one or more embodiments of the present disclosure significantly reduces the likelihood of costly (10+ million USD) mitigation and recovery operations due to debris failures of isolation valves.

Further, the isolation valve system according to one or more embodiments of the present disclosure enables isolation valves engineering to qualify higher pressure rated valves. Higher pressure rated valves must overcome more compacted debris. Prior to the present disclosure, the pressure rating of the barrier was limited by the debris performance of the valve. Higher pressure ratings enable isolation valves to enter the market for HPHT (high pressure, high temperature) wells.

Further, the isolation valve system according to one or more embodiments of the present disclosure improves the repeatability/reliability of isolation valves in debris laden environments. Comparative data is illustrative of this key advantage. For example, a baseline valve required two applications of 75,500 lbs to open the valve in debris in a first test, and 63 applications of 75,500 lbs to open the valve in a second test. In contrast, in the isolation valve system according to one or more embodiments of the present disclosure, only 3,000 lbs of force was required to open the valve for both the first and second tests. Debris performance is a key differentiator in the isolation valve market, and the improved performance may result in increased sales.

Further, the isolation valve system according to one or more embodiments of the present disclosure reduces the cost of isolation valve products. That is, one or more embodiments of the present disclosure enable engineering to utilize less expensive metals in the design because less force is required to actuate the ball components.

In addition to the above, the isolation valve system according to one or more embodiments of the present disclosure provides numerous design advantages. For example, one or more embodiments of the present disclosure reduces the stress on all components involved in actuating the valve. Consequently, less force is required for the actuation of the valve. This enables engineering to reduce the requirements on the metallurgy (e.g., minimum yield strength), which may reduce costs for raw materials and manufacturing costs. Additionally, components could be reduced in size/cross-section due to the reduction in stress. This may enable the overall design to be reduced in size, which saves manufacturing costs.

Further, the isolation valve system according to one or more embodiments of the present disclosure enables engineering to design valves with lower force requirements from the internal, remote opening or mechanical force generating mechanisms required to actuate the valve. Prior designs mitigate debris by transmitting an overwhelming amount of force to the ball section. Generating the overwhelming force requires complex, expensive and large components (e.g., large nitrogen chambers) to be incorporated into the design. With the lower shifting requirements of one or more embodiments of the present disclosure, however, these internal force-generating mechanisms can be simplified and made smaller.

Figure 7:
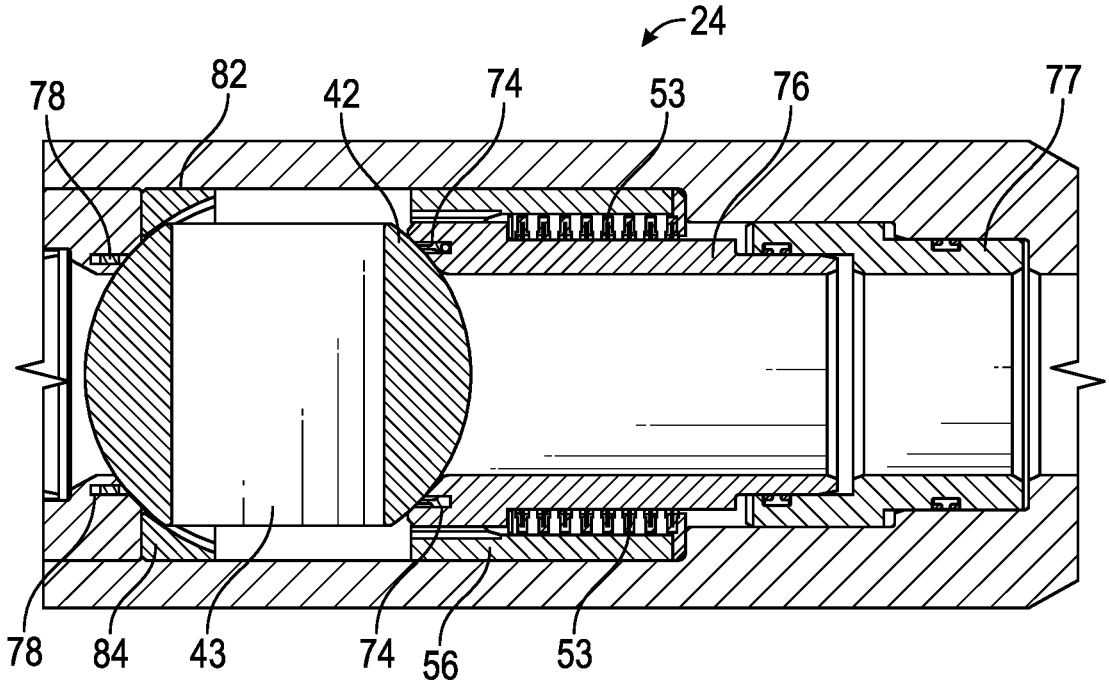
FIG. 7 is an example of a seal mechanism for a ball valve in an isolation valve system, according to one or more embodiments of the present disclosure.
Figure 8:
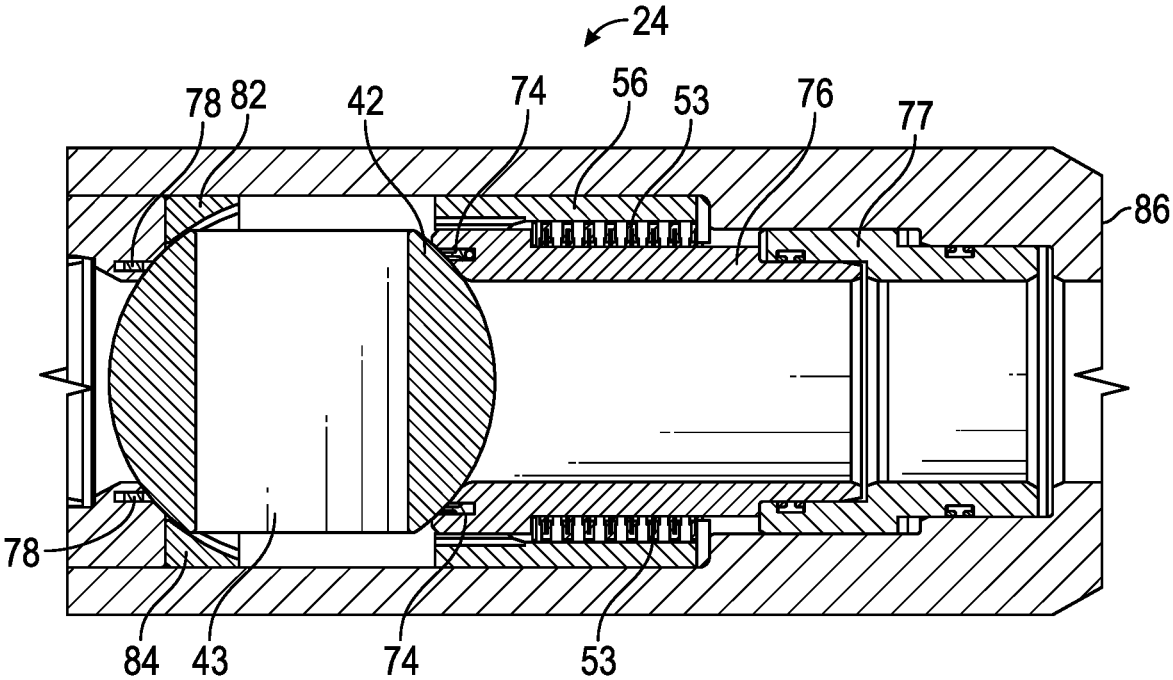
FIG. 8 is an example of a seal mechanism for a ball valve in an isolation valve system, according to one or more embodiments of the present disclosure.

In accordance with one or more embodiments of the present disclosure, the ball valve mechanism relies on a plurality of seals to isolate above ball pressure from below ball pressure. Referring now to FIGS. 7-8, an example of a seal mechanism for a ball valve in an isolation valve system, according to one or more embodiments of the present disclosure is shown. Similar to FIGS. 5-6 as previously described, the seal mechanism of shown in FIGS. 7-8 includes a seal 74 that is contained in a seal retainer 76, which helps to maintain the seal 74 in contact with the ball 42. As further shown in FIGS. 7-8, a seal follower 77 or floating piston may assist the seal retainer 76 with maintaining the seal 74 in contact with the ball 42. In this way, the seal mechanism according to one or more embodiments utilizes the seal follower 77 to apply a booster force on the seal retainer 76. As shown in FIG. 7, the seal follower 77 moves up against the seal retainer 76 when there is pressure below the ball 42. This generates a force on the seal retainer 76.

As shown in FIG. 8, the seal follower 77 moves down against the bottom sub 86 when there is pressure above the ball 42. The seal retainer 76 is pushed up against the ball 42 due to a piston area between the seal retainer 76 stinger diameter and the ball seal diameter.

Figure 9:
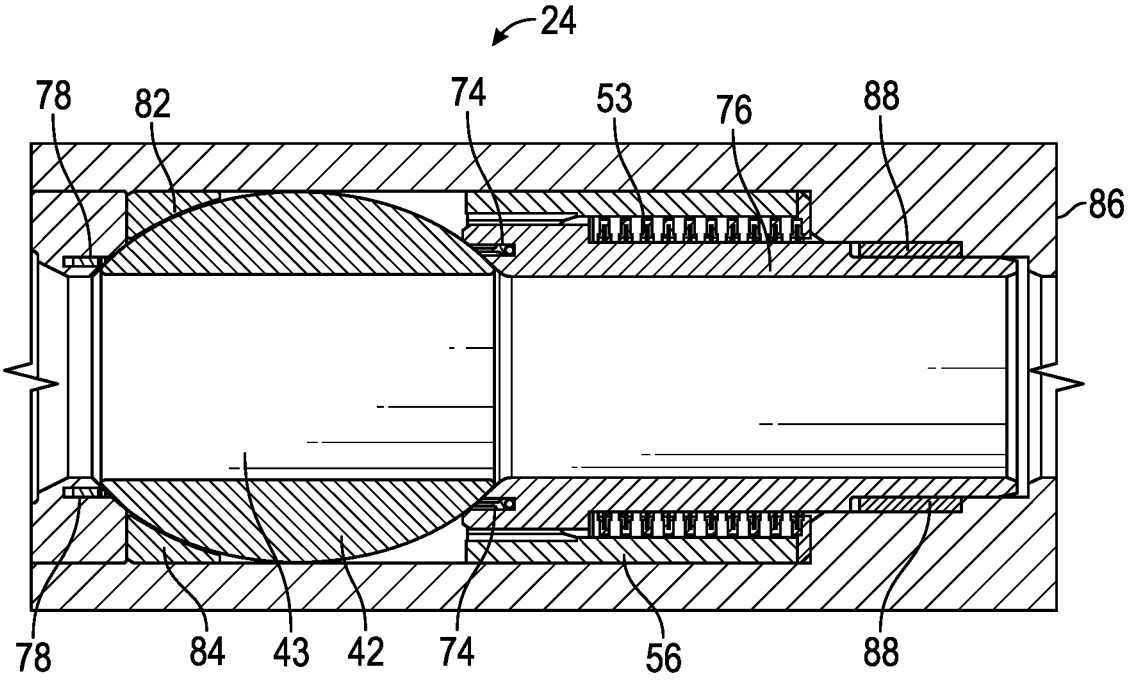
FIG. 9 is an example of a seal mechanism for a ball valve in an isolation valve system, according to one or more embodiments of the present disclosure.

Referring now to FIG. 9, an example of a seal mechanism for a ball valve in an isolation valve system, according to one or more embodiments of the present disclosure is shown. As shown in FIG. 9, the seal follower 77 shown in FIGS. 7-8 may be removed and replaced with a floating seal 88 according to one or more embodiments. The floating seal 88 is loosely constrained between the seal retainer 76 and the bottom sub 86. The floating seal 88 will function in a similar way as the seal follower 77 shown in FIGS. 7-8. For example, in addition to sealing, the floating seal 88 is designed to provide a booster force on the seal retainer 76 and the ball seal 74. Advantageously, in one or more embodiments, replacing the seal follower 77 with the floating seal 88 may result in an increase in hydraulic force such that a smaller resilient member 53 may be used in the isolation valve 24. According to one or more embodiments of the disclosure, the floating seal 88 will move up and apply a load on the seal retainer 76 when the pressure is below the ball 42, and the floating seal 88 will move down when the pressure is above the ball 42. In addition to the floating seal 88 that is used to replace the seal follower 77, the seal mechanism of FIG. 9 also includes seal 74 disposed along one end of ball 42, similar to the seal 74 shown in FIGS. 5-8.

Advantageously, the seal mechanism shown in FIG. 9 provides additional flexibility in the seal design, according to one or more embodiments of the disclosure. For example, the floating seal 88 that replaces the seal follower 77 may be designed to be more robust (e.g, a seal stack may be used to provide redundancy).

According to one or more embodiments of the present disclosure, replacing the seal follower 77 of the seal mechanism with the floating seal 88, provides numerous design advantages. For example, the seal mechanism with the floating seal 88 eliminates a leak path in the barrier. Existing isolation valves include three seals (i.e., three leak paths) in the barrier. However, the seal mechanism with the floating seal 88 according to one or more embodiments of the present disclosure reduces the number of leak paths to two leak paths.

Further, the seal mechanism with the floating seal 88 according to one or more embodiments of the present disclosure improves the reliability of the barrier. That is, the seal mechanism according to one or more embodiments offers a more reliable and repeatable mechanism for sealing a ball valve.

Further, the seal mechanism with the floating seal 88 according to one or more embodiments of the present disclosure eliminates the need to use elastomeric seals. That is, in one or more embodiments, the seals of the seal mechanism may be made of a non-elastomeric material, which may significantly increase the life and robustness of the barrier.

Moreover, the seal mechanism with the floating seal 88 according to one or more embodiments of the present disclosure may reduce the cost of the valve by shortening the length of the valve and removing components from the valve.

Although embodiments of the present disclosure have been described with respect to isolation valves, embodiments of the present disclosure may also be used in any product utilizing a ball valve in a debris laden environment.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. An isolation valve system, comprising:

a well string having an isolation valve, the isolation valve comprising:

a ball rotatably mounted to a pair of inserts for rotation about a fixed axis, the ball having a through hole;

an arm coupled to the ball at a position offset from the fixed axis, the arm having an actuation end;

a mandrel connected to the actuation end of the arm, the mandrel and the actuation end of the arm being disposed uphole of the ball;

wherein, via the actuation end of the arm, the mandrel forces rotation of the ball from a closed position to an open position by moving in a linear direction away from the ball, which allows flow of fluid along the through hole; and wherein movement of the ball from the closed position to the open position comprises the ball moving in a combination of rotation in a counter-clockwise direction and linear movement; and wherein moving the mandrel in the linear direction away from the ball opens the isolation calve and creates space and flow paths for debris to move during rotation of the ball.

2. The isolation valve system of claim 1, wherein movement of the mandrel in the linear direction away from the ball is motivated hydraulically.

3. The isolation valve system of claim 1, wherein movement of the mandrel in the linear direction away from the ball is motivated mechanically.

4. The isolation valve system of claim 1, wherein the arm comprises a yoke arm having an engagement end that moves through a slot formed in the ball.

5. The isolation valve system of claim 1, wherein each insert is formed as a separate insert independently held in position in a corresponding pocket within a valve housing by an upper cage and a lower cage, and wherein the upper cage comprises a window that receives the actuation end of the arm to limit movement of the actuation end of the arm.

6. The isolation valve system of claim 1, wherein the ball is made out of a material selected from the group consisting of: metallic; thermoplastic; elastomeric; dissolvable; shape memory alloy; and a combination thereof.

7. The isolation valve system of claim 1, further comprising a seal retainer having a seal that is held against the ball.

8. A method for isolating a formation, comprising:

providing an isolation valve with a ball having a through hole;

rotatably mounting the ball within a pair of separately insertable inserts held within a valve housing to enable rotation of the ball about a fixed axis;

connecting a first end of an arm to the ball at a position offset from the fixed axis, the first end being an engagement end of the arm;

coupling a second end of the arm to a movable mandrel to enable selective shifting of the ball between open and closed positions by movement of the arm, the mandrel and the second end of the arm being disposed uphole of the ball; and using the mandrel, via the second end of the arm, to force rotation of the ball from the closed position to the open position by moving in a linear direction away from the ball, which allows flow of fluid along the through hole of the ball, wherein movement of the ball from the closed position to the open position comprises the ball moving in a combination of rotation in a counter-clockwise direction and linear movement; and wherein moving the mandrel in the linear direction away from the ball opens the isolation valve and creates space and flow paths for debris to move during rotation of the ball.

9. The method of claim 8, wherein movement of the mandrel in the linear direction away from the ball is motivated hydraulically.

10. The method of claim 8, wherein movement of the mandrel in the linear direction away from the ball is motivated mechanically.

11. The method of claim 8, wherein the engagement end of the arm moves through a slot formed in the ball.

12. The method of claim 8, wherein each insert is independent held in position in a corresponding pocket within a valve housing by an upper cage and a lower cage, and wherein the upper cage comprises a window that receives the second end of the arm to limit movement of the second end of the arm.

13. The method of claim 8, wherein the ball is made out of a material selected from the group consisting of: metallic; thermoplastic; elastomeric; dissolvable; shape memory alloy; and a combination thereof.

14. The method of claim 8, wherein the isolation valve further comprises a seal retainer having a seal that is held against the ball.

* * * * *